US009427134B2

(12) United States Patent
Fetzer et al.

(10) Patent No.: US 9,427,134 B2
(45) Date of Patent: Aug. 30, 2016

(54) STATIONARY HOUSEHOLD APPLIANCE, IN PARTICULAR A DISHWASHER

(75) Inventors: Gerhard Fetzer, Gundelfingen (DE); Dieter Hotz, Dischingen (DE); Cengiz Kücük, Syrgenstein (DE)

(73) Assignee: BSH Hausgeräte GmbH, Munich (DE)

( * ) Notice: Subject to any disclaimer, the term of this patent is extended or adjusted under 35 U.S.C. 154(b) by 1263 days.

(21) Appl. No.: 12/934,271

(22) PCT Filed: Mar. 27, 2009

(86) PCT No.: PCT/EP2009/053691
§ 371 (c)(1),
(2), (4) Date: Sep. 24, 2010

(87) PCT Pub. No.: WO2009/121815
PCT Pub. Date: Oct. 8, 2009

(65) Prior Publication Data

US 2011/0018409 A1 Jan. 27, 2011

(30) Foreign Application Priority Data

Mar. 31, 2008 (DE) ..... 10 2008 016 479

(51) Int. Cl.
*A47L 15/42* (2006.01)
*D06F 39/00* (2006.01)

(52) U.S. Cl.
CPC ..... *A47L 15/4268* (2013.01); *A47L 15/4255* (2013.01); *A47L 15/4261* (2013.01); *D06F 39/001* (2013.01)

(58) Field of Classification Search
CPC ..... A47L 15/4265; A47L 15/4261; A47L 15/4272; A47L 15/4263; A47L 15/0052; A47L 15/4268; A47L 15/4257; A47L 15/4259; E05Y 2900/304; D06F 39/001; D06F 37/10; D06F 37/18; D06F 37/28; D06F 37/42; D06F 39/14; D06F 49/003; E05D 11/08; E05D 2005/145; E05D 2005/108
USPC ..... 312/228, 319.2; 134/56 D
See application file for complete search history.

(56) References Cited

U.S. PATENT DOCUMENTS 4,739,781 A * 4/1988 Casoli ..... 134/115 R
4,746,177 A 5/1988 Lampman et al.

(Continued)

FOREIGN PATENT DOCUMENTS

DE 4443920 A1 6/1996
DE 4446961 A1 7/1996

(Continued)

OTHER PUBLICATIONS

DE202007013030—Machine Translation, Jan. 2008.*
Granting Decision RU 201040987 dated Jun. 25, 2013.

*Primary Examiner* — Michael Kornakov
*Assistant Examiner* — Marc Lorenzi
(74) *Attorney, Agent, or Firm* — Michael Tschupp; Andre Pallapies

(57) ABSTRACT

A stationary household appliance having a housing wall, components, and a force transmitting element to transmit a force that acts upon the housing wall from the outside of the stationary household appliance into the components. The force transmitting element has at least two force application regions to transmit the force into at least two different ones of the components.

27 Claims, 3 Drawing Sheets

(56) References Cited

U.S. PATENT DOCUMENTS

| | | | | |
|---|---|---|---|---|
| 4,787,121 | A * | 11/1988 | Racenis et al. | 16/356 |
| 5,860,436 | A * | 1/1999 | Hobday | 134/58 D |
| 5,992,954 | A * | 11/1999 | Becker | 312/228 |
| 8,231,738 | B2 * | 7/2012 | Haeberle | 134/56 D |
| 2007/0119482 | A1 * | 5/2007 | Gunnerson et al. | 134/56 D |
| 2008/0122331 | A1 * | 5/2008 | Haeberle | 312/319.1 |
| 2009/0126765 | A1 * | 5/2009 | Buehlmeyer et al. | 134/115 R |
| 2011/0187246 | A1 * | 8/2011 | Shin et al. | 312/228 |

FOREIGN PATENT DOCUMENTS

| | | | | |
|---|---|---|---|---|
| DE | 19634452 | A1 | | 3/1998 |
| DE | 102005062478 | A1 | * | 7/2007 |
| DE | 202007013030 | U1 | * | 1/2008 |
| EP | 0221612 | B1 | | 1/1992 |
| EP | 0711527 | A1 | | 5/1996 |
| EP | 1183988 | A3 | | 3/2002 |
| EP | 0916760 | B1 | | 3/2003 |
| EP | 1548366 | A2 | | 6/2005 |
| WO | 2007141296 | A1 | | 12/2007 |

* cited by examiner

STATIONARY HOUSEHOLD APPLIANCE, IN PARTICULAR A DISHWASHER

BACKGROUND OF THE INVENTION

The invention relates to a stationary household appliance, in particular a dishwasher.

The transportation or stacking of stationary household appliances, in particular dishwashers, may take place at the factory using a clamping device, wherein clamping elements press with a holding force from outside onto the opposite side walls of the stationary household appliance housing.

In order to avoid transportation damage such as possible deformations occurring at the side walls in this situation, in a generic stationary household appliance a force transmitting element or force transducer which is capable of absorbing a force acting upon the housing wall from the outside is provided between a function element situated inside the housing and the housing wall. A holding force exerted from outside upon the housing side wall can thus be applied into the functional part inside the housing by way of the force transducer without this resulting in a deformation of the housing side wall. In this situation, the force transmitting element can transmit the force into structural components of the stationary household appliance at least two force application regions.

BRIEF SUMMARY OF THE INVENTION

The object of the invention consists in making available a stationary household appliance which is able to reliably absorb holding forces with a reduced dead weight and increased functionality.

The invention is based on a stationary household appliance, in particular a dishwasher, at least having one housing wall and with at least one force transmitting element which transmits a force acting upon the housing wall from the outside into structural components of the stationary household appliance.

According to the characterizing portion of claim 1, the force transmitting element has at least two force application regions for transmitting force into at least two different structural components of the stationary household appliance. In this manner, at least two force paths parallel to one another are provided to the two different structural components. The applied clamping forces are thus distributed over the at least two structural components, with the overall result that the risk of damaging the structural components is reduced. The invention is applicable to all stationary household appliances, for instance a dishwasher, a stove/oven, a washing machine or a dryer.

By preference, a first force application region can be provided in a hinge support, on which is articulated a pivoting hinge lever of an appliance door of the stationary household appliance. The second force application region can by contrast be provided in a front frame delimiting a loading opening of the stationary household appliance.

By preference, the clamping forces can be applied into the stationary household appliance in further force paths. Thus, a third force application region can be provided in the hinge lever of the appliance door. A fourth force application region can be provided in a base of the stationary household appliance.

The force transmitting element can have one or more supporting elements projecting therefrom, which are supported against the structural components of the stationary household appliance. In order to ensure an even application of force into the at least two different structural components, at least one supporting element can be associated with each of the force application regions respectively. In this situation, in an exemplary embodiment which is simple to manufacture the supporting elements associated with the force application regions can all be supported against the hinge support.

The stationary household appliance can have two opposing lateral hinge supports, between which the appliance door is arranged. The two hinge supports spaced apart from one another can be linked with one another by way of a force transmitting cross member, for instance a base rail which supports the two hinge supports with respect to the clamping forces.

The force transmitting element can have a plate-like basic element having at least one supporting element projecting therefrom, which can support itself against the stationary household appliance structural component. According to the invention, the force transmitting element is therefore not a compact structural component consisting of solid material. Rather, the force transmitting element can bear with its plate-like basic element on the housing wall in order to avoid indentations on the housing wall. On the side facing the functional part, the force transmitting element is however not in contact over its entire area but in accordance with its lightweight construction only with the at least one supporting element projecting from the plate-like basic element. As a result, weight can be saved overall—given appropriate dimensioning of the supporting element—without adversely affecting the functionality of the force transmitting element.

In order to further reduce the weight and to increase the strength, the plate-like basic element of the force transmitting element can have lattice-like stiffening walls, which by way of example are arranged in the manner of a honeycomb structure. In this situation, the stiffening walls and the supporting element can be arranged on a common side surface of the basic element, which preferably faces away from the housing wall.

In terms of installation, the force transmitting element can preferably be designed to be formed from the same material throughout and in one piece and for instance be manufactured as a plastic or metal injection molded part. In order to achieve a reduction in components, latching elements can be formed in one piece on the force transmitting element, by means of which the force transmitting element can be captively pre-fixed to the functional part. To realize a compact design, it is advantageous if the latching element is formed directly on the frontal supporting surface of the supporting element of the force transducer.

As already mentioned above, lateral hinge supports in particular, between which an appliance door is articulated in pivoting fashion, are suitable as functional parts in the housing interior for the application of force and/or for mounting the force transmitting elements according to the invention. In the case of a dishwasher, the appliance door can pivot around a horizontal axis of rotation in order to open or close the washing container which is open at the front.

The two lateral hinge supports are normally stiff, plate-like sheet metal parts which are held in a base group of the dishwasher. The lateral hinge supports together with the appliance door articulated thereto and connected between form an extremely stiff structure in the side direction of the appliance, to which the lateral holding forces acting on it from outside can be applied without causing damage.

Normally the appliance door is articulated in rotatable fashion by way of lateral hinge levers on bearing pins which are seated in the hinge supports. The two hinge levers of the appliance door can moreover each have a lever arm which is also pivoted laterally along the hinge support. The lever arm can be connected to a compensation device which for instance by way of a spring exerts a compensation moment on the appliance door which counteracts the weight moment of the appliance door. Through appropriate dimensioning of the compensation device, the moments acting on the appliance door are always in equilibrium regardless of the pivot position of the appliance door.

The lever arm of the hinge lever of the appliance door can be arranged in one side direction of the appliance between the respective hinge support and the force transmitting element. In this case, the force transmitting element can overlap the lever arm of the hinge lever in hood-like fashion. The supporting element of the force transmitting element should be arranged here outside the pivot path of the lever arm. In particular, a free space into which the lever arm of the hinge lever can be pivoted without impairment can be provided between the force transmitting element and the hinge support.

By preference, in the region of the hinge lever the base plate of the force transmitting element can have a raised contact contour. In the normal state this can be spaced away from the hinge lever and only in the event of an external application of force be deflected onto the force transmitting element with elastic resilience until contact is made with the hinge lever. In this case, the lateral holding forces can be applied directly by way of the hinge lever into the stiff hinge structure.

When the stationary household appliance is fully installed, the lever arm of the door-side hinge lever protrudes through a hinge opening of a front frame part delimiting the washing container opening right into the free space delimited by the hinge support and by the force transducer. This free space is thus configured to be open towards the outside by way of the hinge opening. Operating noises inside the housing can thus issue to the exterior through the free space and the front-side hinge opening. In order to prevent this, the force transmitting element can have sound-damping walls which preferably can extend between the force transmitting element and hinge support. In this manner, said free space for the lever arm of the hinge lever is separated with respect to the housing interior. In addition, the sound-damping walls can at least partially cover the hinge opening on the front side, by which means the noise emission from the appliance is further inhibited.

In order to further increase its stiffness, the plate-like basic element of the force transducer can have a side wall running all round the edge. The basic element is thus designed to be approximately dish-shaped. When the force transmitting element is installed, the flat dish base can be in contact with the housing side wall and the side wall running all around the edge can project in the direction of the functional part.

BRIEF DESCRIPTION OF THE DRAWINGS

An exemplary embodiment of the invention will be described in the following with reference to the attached figures.

In the drawings.

DETAILED DESCRIPTION OF THE EXPLEMARY EMBODIMENTS OF THE PRESENT INVENTION

Figure 1:
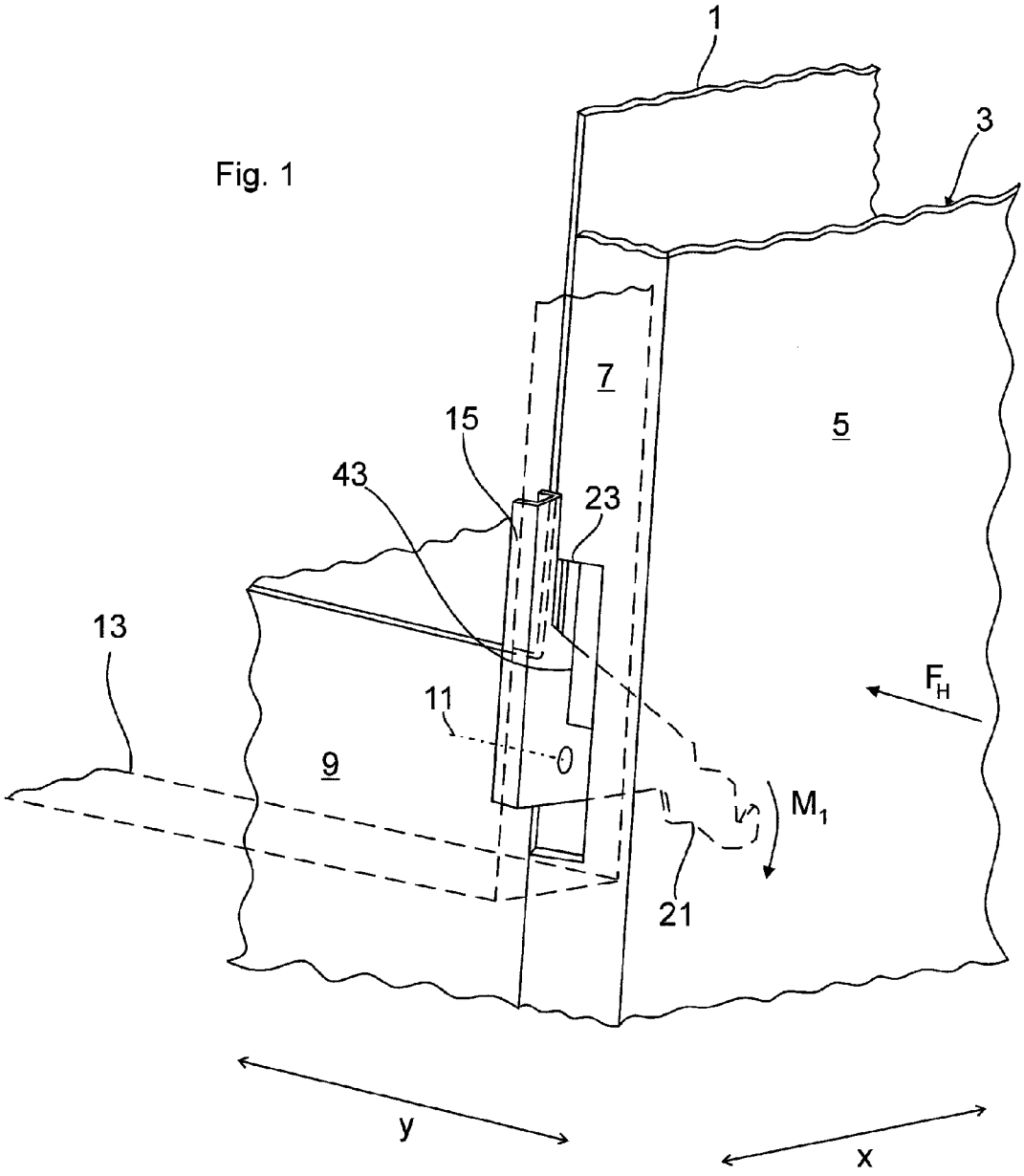
FIG. 1 shows a perspective partial view of a dishwasher.

FIG. 1 shows a perspective partial view of a dishwasher having a washing container 1 which is open at the front. The washing container 1 is usually arranged in an outer housing 3 of the dishwasher. Only a housing side wall 5 and front frame elements 7, 9 of the outer housing 3, which delimit a front loading opening of the washing container 1, are shown in FIG. 1. The front loading opening of the washing container 1 can be closed by means of an appliance door 13, articulated in pivoting fashion around a horizontal axis of rotation 11, which is indicated in FIG. 1 only by means of dashed lines.

Figure 2:
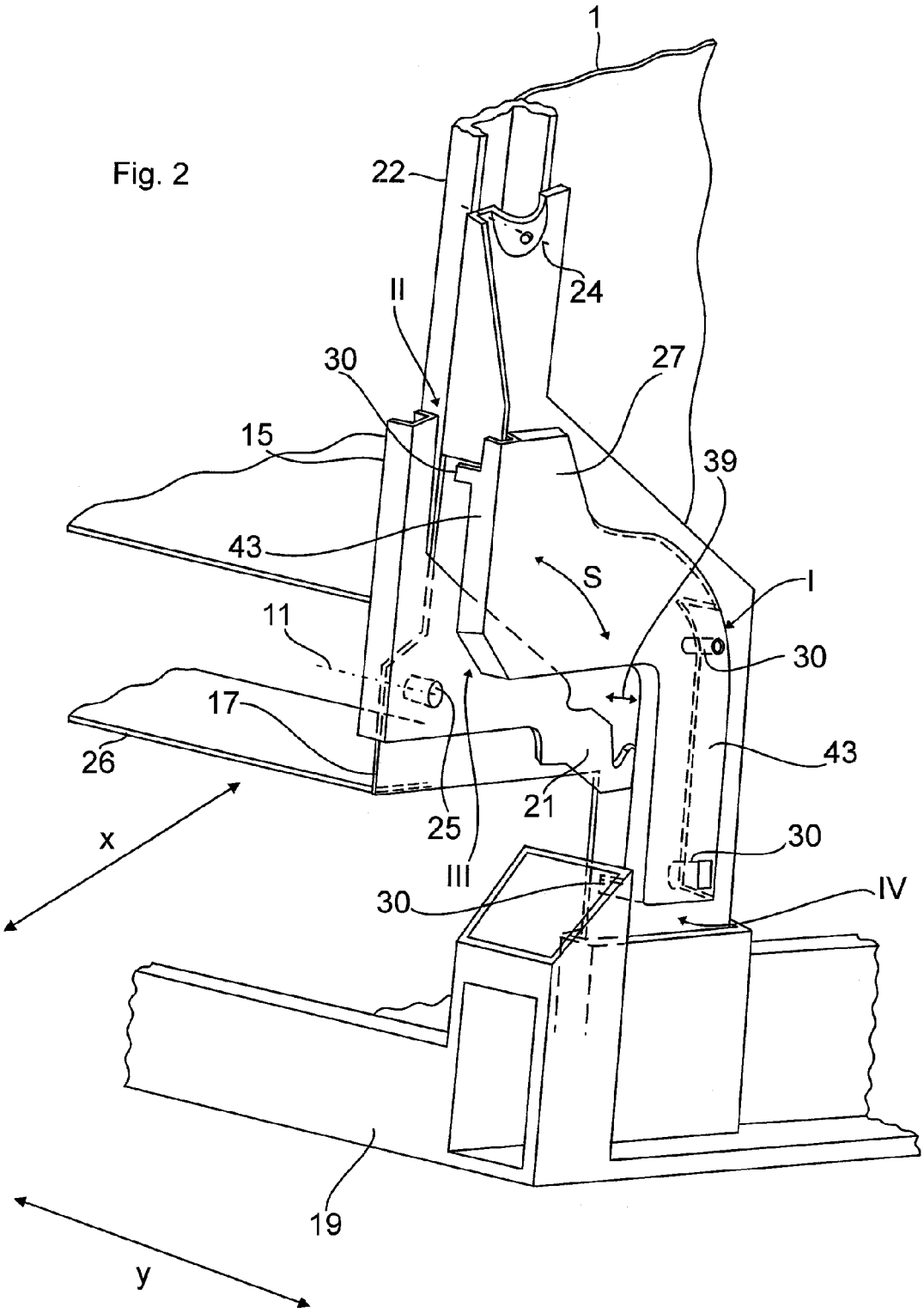
FIG. 2 shows in a further perspective view a lateral hinge region of the dishwasher, on which an appliance door is articulated.

The appliance door 13 is supported in the usual manner on both sides by means of hinge levers 15. The hinge levers 15 are in turn articulated by way of bearing pins 25 to lateral plate-like hinge supports 17, only one of which is shown in FIG. 2. According to FIG. 2, the hinge support 17 is a sheet metal part of an approximately angular configuration, the vertical arm of which is held laterally in a base group 19 of the dishwasher.

The hinge lever 15 of the appliance door 13 has a lever arm 21 which projects laterally beneath the washing container 1 through a hinge opening 23 in the vertical front frame part 7 into the housing interior. The lever arm 21 is operatively connected to a compensation device (not shown) which exerts a compensation moment $M_1$ clockwise on the appliance door 13, which counteracts the weight moment of the appliance door 13 acting counterclockwise. In the two FIGS. 1 and 2, only the right-hand hinge region of the dishwasher is shown in each case. The corresponding left-hand hinge region (not shown) is of identical construction.

As can also be seen from FIG. 2, the hinge lever 15 is rotatably mounted in the side direction y laterally outside the hinge support 17 on the latter's bearing pins 25. In this situation, the lever arm 21 of the hinge lever 15 moves along an outer side surface of the hinge support 17. The two hinge supports 17 arranged in each case in the lateral region of the dishwasher together with the appliance door 13 arranged between them overall form a hinge structure which is extremely stiff in the side direction y. This can absorb holding forces $F_H$ acting laterally on the opposing side walls 5 without any damage during a transport situation.

According to FIG. 2, the front loading opening of the washing container 1 is delimited by a front frame 22. This is supported in the usual manner against the hinge support 17 by way of its lateral frame strip shown in FIG. 2. For a fixed connection with the hinge support 17, the front frame 22 is screwed together with the hinge plate 17 by means of an indicated screw connection 24.

The two lateral hinge supports 17 are furthermore connected together beneath the washing container base by way of a cross member, in other words the indicated base rail 26. The base rail 26 of planar configuration closes off to the front an assembly opening to the motor compartment. Furthermore, the base rail 26 is used for noise damping and can be provided with a corresponding damping layer, a bitumen layer for instance.

In order to apply the holding force $F_H$ from the respective housing side wall 5 into the dishwasher, according to FIG. 2 a force transmitting element 27 is provided which absorbs a holding force $F_H$ acting from outside on the side wall 5 and applies it into the interior of the dishwasher.

The force transmitting element 27 is supported according to FIG. 2 by way of supporting elements 30 on the outside on the hinge support 17 shown. In this situation, the supporting elements 30 are widely distributed over the entire hinge support 17 in such a manner that the associated force application regions I, II, III, IV are associated with different structural components, in other words the hinge support 17, the front frame 22 of the washing container 1, the base group 19 and the hinge lever 15.

The first force application region I here is associated with the hinge support 17, while the second force application region II is associated with the front frame 22. In contrast, the third force application region III is associated with the hinge lever 15 of the appliance door 13 and the fourth force application region IV is associated with the base group 19. In this manner, not only a single structural component is subjected to the clamping force $F_H$. Rather, the force application regions I, II, III, IV make available force paths running parallel to one another, by means of which the clamping forces $F_H$ are distributed over the hinge plate 17, the base group 19, the front frame 26 and the hinge lever 15.

Figure 3:
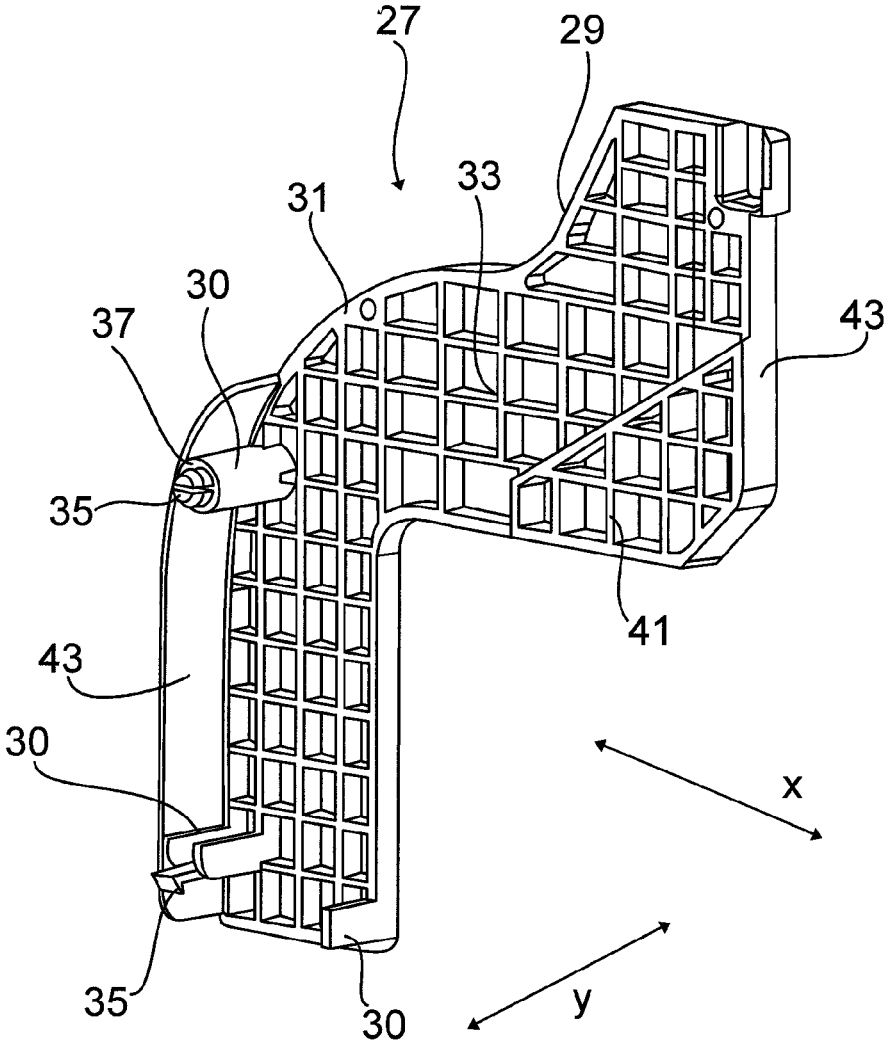
FIG. 3 shows a force transducer according to the invention on its own.

The force transducer or the force transmitting element 27 is shown on its own in FIG. 3. The force transducer 27 here is designed as an injection molded plastic part in one piece and formed from the same material throughout. Overall, the force transducer 27 is implemented in lightweight construction in its geometrical configuration. To this end, the force transducer 27 has a plate-like basic element 29 and supporting elements 30 projecting therefrom. The plate-like basic element 29 has a closed smooth surface facing the side wall 5 in order to avoid indentations or dents in the side wall 5 during transportation. The closed smooth surface of the force transducer 27 is delimited by a side wall 31 miming all around the edge, which projects in the direction of the hinge support 17. Together with the closed smooth outer surface of the force transducer 27, the side wall 31 running all around the edge overall forms an approximately dish-shaped structure which incorporates lattice-like stiffening walls 33.

The supporting elements 30 of the force transmitting element 27 projecting from the basic element 29 are designed differently according to FIG. 3. Thus, a first supporting element 30 is configured as a cylindrical latching dome, on the front of which, facing the hinge support 17, a latching element 35 is formed centrally. The latching element 35 is surrounded by an annular surface 37 which is supported against the hinge support 17. The second supporting element 30 has two supporting struts spaced apart from one another, between which is arranged a further latching element 35 which overtops the two struts in the side direction of the appliance y. Both latching elements 35 can engage behind corresponding latching openings in the hinge support 17. The third supporting element 30 is designed without an additional latching element 35 and is supported merely on the side surface of the hinge support 17.

In FIG. 2, the force transducer 27 is shown latched laterally to the hinge support 17. In this situation, the plate-like basic element 29 is spaced by way of a free space 39 from the hinge support 17 by means of the supporting elements 30. According to FIG. 2, the lever arm 21 of the hinge lever 15 protrudes into the free space 39 formed between the hinge support 17 and the force transmitting element 27. In this situation, the supporting elements 30 are positioned such that they do not impede the pivot path S of the lever arm 21.

As can be seen further from FIG. 3, a contact contour 41 raised from the stiffening walls 33 is also formed in addition to the supporting elements 30. In the normal state the contact contour 41 is spaced away from the lever arm 21 of the hinge lever 15 so as not to impede the door pivoting motion. In the event of an application of force by means of the lateral holding force $F_H$, the force transducer deflects in the region of the contact contour 41 with elastic resilience until contact is made with the lever arm 21. In this manner, the holding force $F_H$ can in addition also be applied by way of the hinge lever 15 into the hinge support 17.

The free space 39 provided between the force transducer 27 and the hinge support 17 is open towards the outside by way of the hinge opening 23 in the front frame part 7. Operating noises from inside the housing are carried outside undamped through the hinge opening 23. In order to achieve a reduction in noise here the force transducer 27 has sound-damping walls 43. A first of the sound-damping walls 43 is arranged in the structural depth direction x on the rear of the force transducer 27 and separates the free space 39 to the rear from the housing interior. Furthermore, according to FIGS. 1 to 3, a vertical section of the side wall 31 situated at the front in the structural depth direction x likewise serves as a sound-damping wall 43. According to FIG. 1, the front sound-damping wall 43 of the force transducer 27 partially covers the hinge opening 23 of the front frame part 7, by which means the noise emission is likewise reduced.

LIST OF REFERENCE CHARACTERS

| List of reference characters | |
|---|---|
| 1 | Washing container |
| 3 | Outer housing |
| 5 | Housing wall |
| 7, 9 | Front frame parts |
| 11 | Axis of rotation |
| 13 | Appliance door |
| 15 | Hinge lever |
| 17 | Hinge support |
| 19 | Base group |
| 21 | Lever arm of hinge lever 15 |
| 22 | Front frame |
| 23 | Hinge opening |
| 24 | Screw connection |
| 25 | Bearing pins |
| 26 | Base rail |
| 27 | Force transducer or force transmitting element |
| 29 | Plate-like basic element |
| 30 | Supporting elements |
| 31 | Side wall running all around edge |
| 33 | Stiffening walls |
| 35 | Latching elements |
| 37 | Annular surface |
| 39 | Free space |
| 41 | Contact contour |
| 43 | Sound-damping walls |
| y | Side direction |
| x | Depth direction |
| S | Pivot path |
| $M_1$ | Compensation moment |
| $F_H$ | Holding force |
| I, II, III, IV | Force application regions |

The invention claimed is:

1. A stationary household appliance, comprising:

a housing having a housing wall;

a plurality of components inside the housing; and a unitary force transmitting element located between the housing wall and the plurality of components and adapted to transmit a force that acts upon the housing wall from the outside of the stationary household appliance into the plurality of components;

wherein the unitary force transmitting element has at least two force application regions adapted to transmit the force into at least two different ones of the plurality of components by simultaneously contacting the at least two different ones of the plurality of components, wherein the unitary force transmitting element has a plate-like element, and wherein, in a region of a hinge lever of an appliance door of the stationary household appliance, the plate-like element of the unitary force transmitting element has a raised contact contour which is spaced away from the hinge lever when the force is not applied and which is deflected with elastic resilience until contact is made with the hinge lever when the force is applied, and wherein the plate-like element has lattice-like stiffening walls.

2. The stationary household appliance of claim 1, wherein the stationary household appliance is a dishwasher.

3. The stationary household appliance of claim 1, further comprising:

a hinge support on which the hinge lever of the appliance door is articulated;

wherein a first force application region of the at least two force application regions is provided to contact the hinge support.

4. The stationary household appliance of claim 1, further comprising a front frame delimiting a loading opening of the stationary household appliance, wherein a second force application region of the at least two force application regions is provided to contact the front frame.

5. The stationary household appliance of claim 3, wherein a third force application region of the at least two force application regions is provided to contact the hinge lever of the appliance door.

6. The stationary household appliance of claim 3, wherein the unitary force transmitting element has at least one supporting element projecting from the unitary force transmitting element, and wherein the at least one supporting element is associated with a respective one of the at least two force application regions.

7. The stationary household appliance of claim 5, further comprising a base, wherein a fourth force application region of the at least two force application regions is provided to contact the base.

8. The stationary household appliance of claim 6, wherein the at least one supporting element is supported against the hinge support.

9. The household appliance of claim 1, further comprising:

two opposing hinge supports;

the appliance door being arranged between the two opposing hinge supports; and a base rail to link the two opposing hinge supports.

10. The stationary household appliance of claim 1, wherein the lattice-like stiffening walls and a supporting element of the unitary force transmitting element are arranged on a common side surface of the plate-like element.

11. The stationary household appliance of claim 10, wherein the side of the plate-like element facing away from the supporting element is situated opposite the housing wall.

12. The stationary household appliance of claim 1, wherein the unitary force transmitting element is one of a plastic injection molded part and a metal injection molded part.

13. The stationary household appliance of claim 1, wherein the unitary force transmitting element has a plurality of latching elements to make a latching connection with a respective one of the plurality of components of the stationary household appliance.

14. The stationary household appliance of claim 13, wherein the plurality of latching elements is formed from at least one of the same material throughout and in one piece on a supporting element of the unitary force transmitting element.

15. The stationary household appliance of claim 14, wherein the supporting element has a frontal supporting surface on which a respective one of the plurality of latching elements is formed.

16. The stationary household appliance of claim 1, wherein the plate-like element has a side wall running all around an edge of the plate-like element.

17. The stationary household appliance of claim 3, wherein the hinge lever has a lever arm connected to a compensation device that exerts a compensation moment to counteract a weight moment of the appliance door.

18. The stationary household appliance as claimed in claim 17, wherein the lever arm of the hinge lever is arranged between the hinge support and the unitary force transmitting element.

19. The stationary household appliance of claim 18, wherein a supporting element of the unitary force transmitting element is arranged outside a pivot path of the lever arm of the hinge lever.

20. The stationary household appliance of claim 1, wherein the unitary force transmitting element has at least one sound-damping wall.

21. The stationary household appliance of claim 20, wherein the sound-damping wall extends from the plate-like element to a hinge support on which a pivoting hinge lever of the appliance door is articulated.

22. The stationary household appliance of claim 20, wherein the sound-damping wall at least partially separates a hinge lever opening on a front side of a housing of the stationary household appliance from an interior portion of the housing.

23. The stationary household appliance of claim 1, wherein the unitary force transmitting element transmits the force into the at least two different ones of the plurality of components through parallel paths.

24. The stationary household appliance of claim 1, wherein the housing wall is exterior to the unitary force transmitting element.

25. The stationary household appliance of claim 1, wherein the force compresses the unitary force transmitting element.

26. The stationary household appliance of claim 1, wherein the unitary force transmitting element is configured to bear against the housing wall when the force is applied and thus avoid indentations on the housing wall.

27. The stationary household appliance of claim 1, wherein the force is an external clamping holding force applied to the housing wall and an opposed housing wall.

* * * * *